US011594359B2

(12) United States Patent
Misaki et al.

(10) Patent No.: US 11,594,359 B2
(45) Date of Patent: Feb. 28, 2023

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Takashi Misaki, Yokkaichi (JP); Shinichiro Yamamoto, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 299 days.

(21) Appl. No.: 16/880,649

(22) Filed: May 21, 2020

(65) Prior Publication Data

US 2020/0381163 A1 Dec. 3, 2020

(30) Foreign Application Priority Data

May 29, 2019 (JP) ..... JP2019-100611

(51) Int. Cl.

| | |
|---|---|
| ***H01F 27/02*** | (2006.01) |
| ***H01F 27/24*** | (2006.01) |
| ***H01F 27/28*** | (2006.01) |
| ***H01F 27/32*** | (2006.01) |
| ***H01F 41/00*** | (2006.01) |
| ***H01F 41/12*** | (2006.01) |
| ***H01F 17/04*** | (2006.01) |
| ***H01F 37/00*** | (2006.01) |

(52) U.S. Cl.

CPC ..... *H01F 27/022* (2013.01); *H01F 17/04* (2013.01); *H01F 27/24* (2013.01); *H01F 27/2823* (2013.01); *H01F 27/327* (2013.01); *H01F 37/00* (2013.01); *H01F 41/005* (2013.01); *H01F 41/127* (2013.01); *H01F 2017/048* (2013.01)

(58) Field of Classification Search

CPC ..... H01F 17/04; H01F 27/022; H01F 27/24; H01F 27/2823; H01F 27/327; H01F 37/00; H01F 41/005; H01F 41/127; H01F 2017/048

See application file for complete search history.

(56) References Cited

U.S. PATENT DOCUMENTS 9,460,842 B2 * 10/2016 Inaba ..... H01F 27/022
9,484,139 B2 * 11/2016 Yamada ..... H01F 27/402

(Continued)

FOREIGN PATENT DOCUMENTS

CN 1958706 * 5/2007
JP 6106645 B * 4/2017

(Continued)

*Primary Examiner* — Carl J Arbes
(74) *Attorney, Agent, or Firm* — Oliff PLC

(57) ABSTRACT

A reactor that includes a coil having a wound portion; a magnetic core; a holding member provided at both ends of the wound portion; a mold resin by which the coil and the holding member are integrated into one piece; a casing that houses an assembly that includes the coil, the magnetic core, and the holding member; and a potting resin that fills up the casing to seal at least a part of the assembly.

5 Claims, 8 Drawing Sheets

(56) References Cited

U.S. PATENT DOCUMENTS

| | | | | |
|---|---|---|---|---|
| 2018/0211758 | A1 | 7/2018 | Shitama et al. | |
| 2019/0131052 | A1* | 5/2019 | Kusawake | H01F 27/022 |

FOREIGN PATENT DOCUMENTS

| | | | | |
|---|---|---|---|---|
| JP | 6106646 | B | * | 4/2017 |
| JP | 6106647 | B | * | 4/2017 |
| JP | 6394852 | B | * | 9/2018 |
| WO | 2015/159640 | | * | 10/2015 |
| WO | 2017/187925 | | * | 11/2017 |

* cited by examiner

REACTOR

BACKGROUND

The present disclosure relates to a reactor.

JP 2017-28142A discloses a reactor that includes a coil having a wound portion, a magnetic core that is disposed inside and outside the wound portion and forms a closed magnetic path, and an end-face interposed member that is interposed between an end face of the wound portion and an outer core portion. The magnetic core includes an inner core portion disposed inside the wound portion, and the outer core portion disposed outside the wound portion. Also, the reactor described in JP 2017-28142A includes an inner resin portion that fills up a space between the inner circumferential surface of the wound portion and the outer circumferential surface of the inner core portion. It is disclosed that the inner resin portion is formed by molding a resin through injection molding.

SUMMARY

There is a demand for further improving the heat dissipation of reactors.

Reactors for use in on-board converters are required for use with higher currents. If a higher current flows through a reactor, the amount of heat generation will increase in not only the coil but also the magnetic core. Particularly, an inner core portion of the magnetic core is arranged inside a wound portion of the coil, and thus the heat of the inner core portion hardly dissipates. Accordingly, the inner core portion tends to accumulate heat and have an increased temperature. Therefore, there is a demand for improving the heat dissipation of the inner core portion.

In the conventional reactor disclosed in JP 2017-28142A, the inner resin portion (hereinafter, referred to as "mold resin portion") fills up the space between the wound portion and the inner core portion. Accordingly, heat from the inner core portion will be transmitted to the wound portion via the mold resin portion. That is to say, a heat dissipation path of the inner core portion passes through, starting from the inner core portion, the mold resin portion and the wound portion, in that order. Typically, the mold resin portion has a relatively low thermal conductivity (a large thermal resistance), and thus is not suited to efficiently transmit the heat generated in the inner core portion to the wound portion.

Accordingly, an exemplary aspect of the disclosure provides a reactor that is superior in terms of heat dissipation.

According to the present disclosure, a reactor includes: a coil having a wound portion; a magnetic core; a holding member provided at both ends of the wound portion; a mold resin by which the coil and the holding member are integrated into one piece; a casing that houses an assembly that includes the coil, the magnetic core, and the holding member; and a potting resin that fills up the casing to seal at least a part of the assembly, wherein the magnetic core includes: an inner core arranged inside the wound portion; and an outer core arranged outside the wound portion, the potting resin has a thermal conductivity that is higher than the thermal conductivity of the mold resin, the mold resin includes a first region and a second region that are formed in one piece, the first region covers at least part of an inner circumferential surface of the wound portion, and the second region latches on the holding member so that the holding member does not disengage from an end face of the wound portion, and both the first region and the potting resin are provided between the wound portion and the inner core.

The reactor according to the present disclosure is superior in terms of heat dissipation.

DETAILED DESCRIPTION OF EMBODIMENTS

Figure 1:
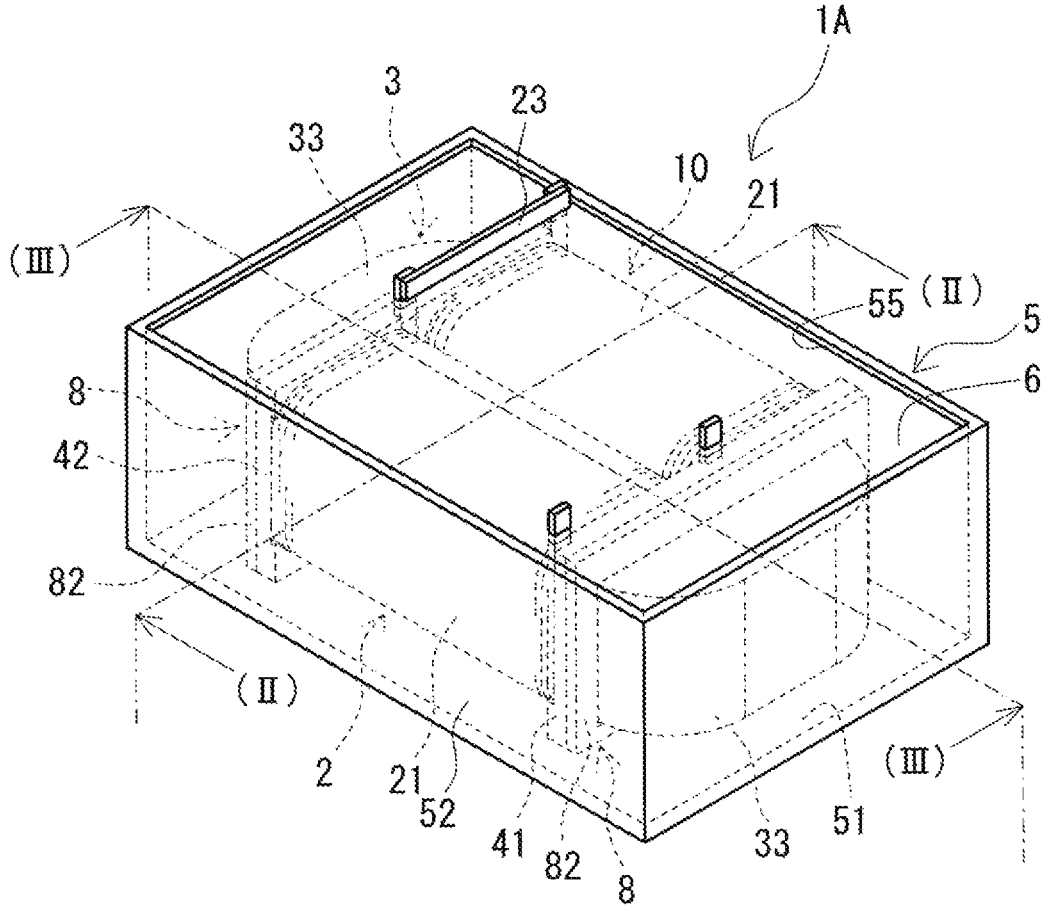
FIG. 1 is a schematic perspective view illustrating a reactor according to Embodiment 1.

Description of Embodiments of the Present Disclosure

First, embodiments of the present disclosure will be described in order.

A reactor according to an embodiment of the present disclosure includes:

a coil having a wound portion;

a magnetic core;

a holding member provided at both ends of the wound portion;

a mold resin portion by which the coil and the holding member are integrated into one piece;

a casing that houses an assembly that includes the coil, the magnetic core, and the holding member; and a potting resin portion that fills up the casing to seal at least a part of the assembly, wherein the magnetic core includes:

an inner core portion arranged inside the wound portion; and an outer core portion arranged outside the wound portion, the potting resin portion has a thermal conductivity that is higher than the thermal conductivity of the mold resin portion, the mold resin portion includes a first region and a second region that are formed in one piece, the first region covers at least part of an inner circumferential surface of the wound portion, and the second region latches on the holding member so that the holding member does not disengage from an end face of the wound portion, and both the first region and the potting resin portion are provided between the wound portion and the inner core portion.

In the reactor of the present disclosure, both the first region of the mold resin portion and the potting resin portion are provided between the wound portion and the inner core portion. The potting resin portion has a thermal conductivity that is higher than that of the mold resin portion (first region). Accordingly, the reactor of the present disclosure can transmit the heat of the inner core portion to the wound portion more efficiently than in a case where only the mold resin portion is provided between the wound portion and the inner core portion. In other words, the heat dissipation of the inner core portion can be improved. Therefore, the reactor of the present disclosure is superior in terms of heat dissipation.

In the reactor of the present disclosure, the coil and the holding member are integrated into one piece by the mold resin portion. Accordingly, the coil and the holding member can be dealt with as one piece, and thus a user can easily assemble the magnetic core (the inner core portion and the outer core portion) and the coil. Also, as a result of the coil and the holding member being integrated into one piece, when the assembly is housed into the casing, the assembly can be arranged in a stable manner. Accordingly, the reactor of the present disclosure is superior in assembly properties.

Moreover, the mold resin portion includes the first region that covers at least part of an inner circumferential surface of the wound portion, and the second region that latches on the holding member so that the holding member does not disengage from an end face of the wound portion. As a result of the first region and the second region being formed in one piece, the wound portion and the holding member are mechanically coupled to each other by the mold resin portion. Therefore, the holding member is not likely to disengage from the coil.

As an aspect of the above-described reactor, the first region covers the whole circumference of the inner circumferential surface of the wound portion, and in a cross section that is orthogonal to an axial direction of the wound portion, the potting resin portion and the first region are stacked on each other between the wound portion and the inner core portion.

In the above-described aspect, the potting resin portion and the first region are stacked on each other between the wound portion and the inner core portion. In other words, a two-layer structure with the potting resin portion and the mold resin portion is provided. In this case, the heat dissipation path of the inner core portion passes through, starting from the inner core portion, the potting resin portion, the mold resin portion (first region), and the wound portion, in that order. Accordingly, with the above-described aspect, it is possible to transmit the heat of the inner core portion to the wound portion more efficiently than in the case where only the mold resin portion is provided between the wound portion and the inner core portion. Therefore, the above-described aspect is superior in terms of heat dissipation.

Furthermore, in the above-described aspect, the first region covers the whole circumference of the inner circumferential surface of the wound portion. Accordingly, an area of contact between the first region and the inner circumferential surface of the wound portion is increased, and thus the strength of joint between the first region and the wound portion is enhanced. Therefore, with the above-described aspect, the wound portion and the holding member can be more strongly coupled to each other by the mold resin portion.

As an aspect of the above-described reactor, in a cross section that is orthogonal to an axial direction of the wound portion, the first region is provided in a partial region, in a circumferential direction, between the wound portion and the inner core portion, and the potting resin portion is provided in the remaining region, in the circumferential direction, between the wound portion and the inner core portion.

In the above-described aspect, the first region is provided in a partial region, in a circumferential direction, between the wound portion and the inner core portion. Accordingly, the first region is thicker than in the case where the potting resin portion and the first region are stacked on each other between the wound portion and the inner core portion. The rigidity of the first region increases the thicker the first region is. Therefore, with the above-described aspect, the wound portion and the holding member can be more strongly coupled to each other by the mold resin portion.

Furthermore, in the above-described aspect, the potting resin portion is provided in the remaining region, in the circumferential direction, between the wound portion and the inner core portion, and thus it is possible to ensure the heat dissipation of the inner core portion.

As an aspect of the above-described reactor, the outer circumferential surface of the wound portion is exposed without being covered by the mold resin portion.

As a result of the outer circumferential surface of the wound portion not being covered by the mold resin portion, heat is likely to dissipate from the wound portion. Accordingly, the above-described aspect improves the heat dissipation of the coil.

As an aspect of the above-described reactor, at least either of the inner core portion and the outer core portion is made of a powder compacted material that contains soft magnetic powder, or a composite material in which soft magnetic powder is dispersed in a resin.

The inner core portion and the outer core portion may be made of a compacted material that contains a soft magnetic material. The powder compacted material is obtained by compacting and molding of soft magnetic powder. The composite material is obtained by dispersing soft magnetic powder in a resin and molding the result. A powder compacted material contains a higher ratio of soft magnetic powder in a core piece than a composite material does, and even if the same type of soft magnetic powder is used, a powder compacted material has higher magnetic characteristics (such as higher relative permeability or higher saturation magnetic flux density). If a composite material is used, it will be easy to control the magnetic characteristics by adjusting the content of soft magnetic powder in a resin.

The inner core portion and the outer core portion may be made of the same constituent material or different constituent materials. If the inner core portion and the outer core portion are made of different constituent materials, for example, the inner core portion may be made of a composite material, and the outer core portion may be made of a powder compacted material. A configuration is also possible in which the inner core portion is made of a powder compacted material, and the outer core portion is made of a composite material. The constituent materials of the inner core portion and the outer core portion can be suitably selected so that the inductance of the reactor is a predetermined value.

Details of the Embodiments of the Present Disclosure

Hereinafter, specific examples of the reactor according to the embodiments of the present disclosure will be described with reference to the drawings. The same reference numerals in the drawings denote the same named member. In the drawings, for ease of description, parts of the configuration may be shown in an exaggerated or simplified manner. Also, dimensional ratios of various portions in the drawings may be different from actual dimensional ratios.

Embodiment 1

Overview

Figure 2:
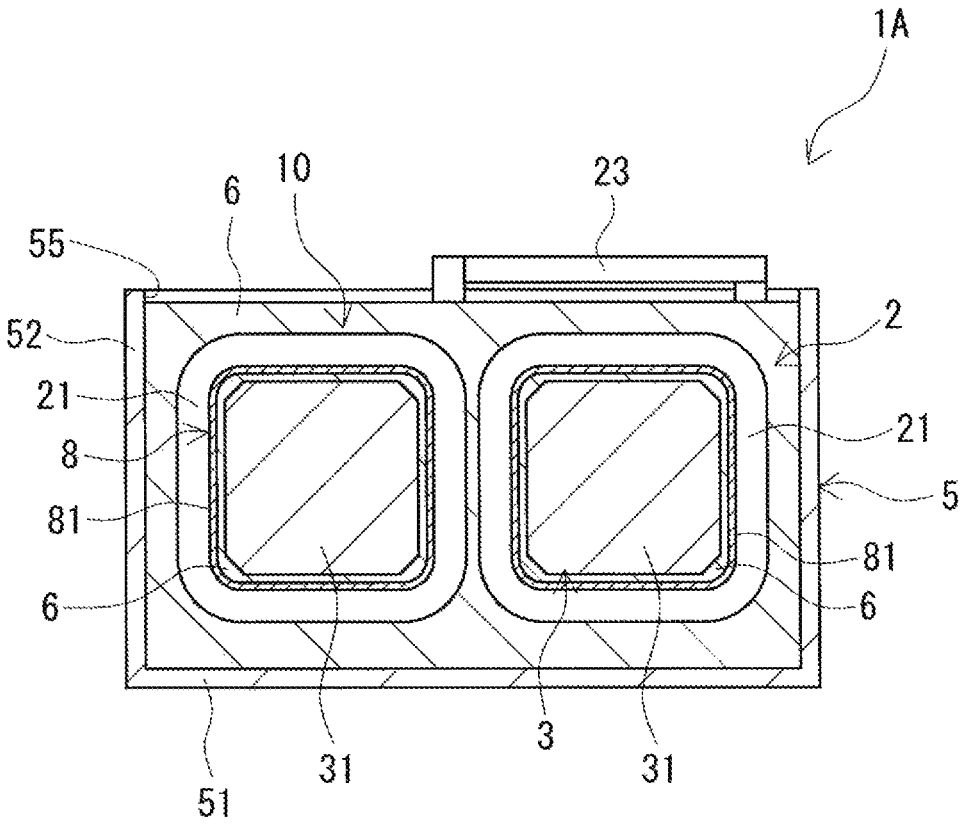
FIG. 2 is a schematic horizontal cross-sectional view taken along a line (II)-(II) shown in FIG. 1.
Figure 3:
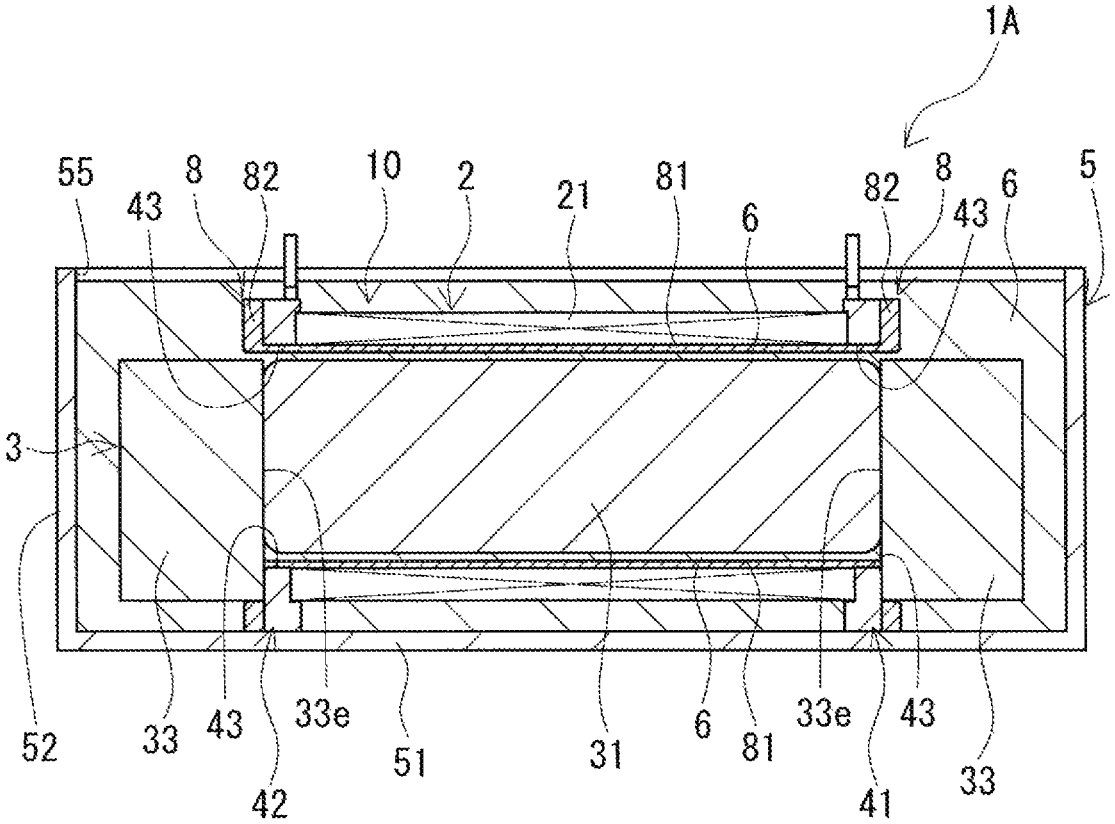
FIG. 3 is a schematic vertical cross-sectional view taken along a line (III)-(III) shown in FIG. 1.
Figure 4:
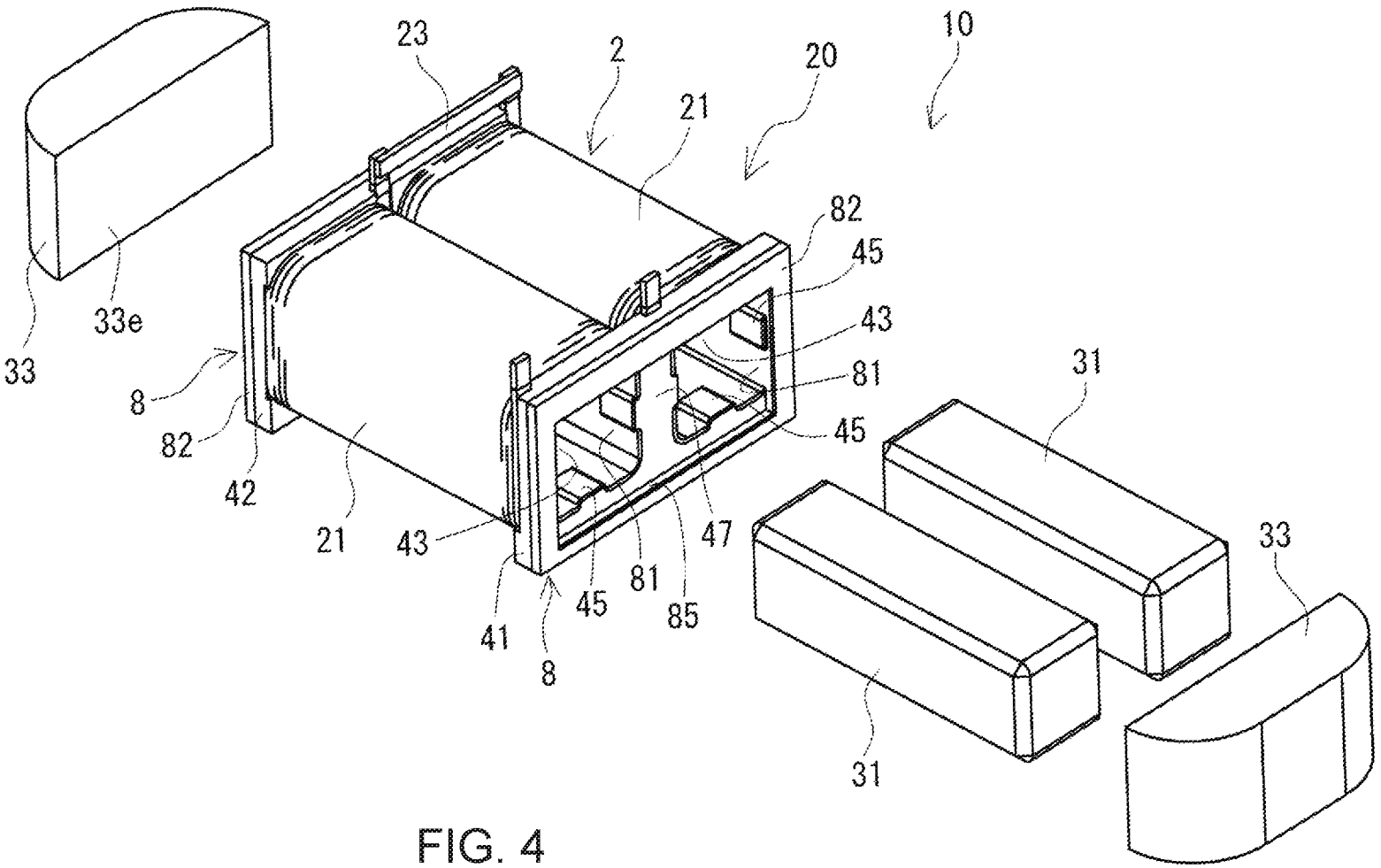
FIG. 4 is a schematic exploded view of an assembly.

The following will describe a reactor 1A according to Embodiment 1 with reference to FIGS. 1 to 7. As shown in FIG. 1, the reactor 1A includes a coil 2, a magnetic core 3, holding members 41 and 42, a casing 5, and a potting resin portion 6 (potting resin). The reactor 1A also includes a mold resin portion 8 (mold resin) (see also FIGS. 2 and 3). The coil 2 includes, as shown in FIG. 1, two wound portions 21 arranged in parallel to each other. As shown in FIGS. 2 and 3, the magnetic core 3 includes inner core portions 31 (inner core) arranged inside the wound portions 21, and outer core portions 33 (outer core) arranged outside the wound portions 21. The holding members 41 and 42 are arranged at the two ends of the wound portions 21. As shown in FIG. 4, the mold resin portion 8 integrates the coil 2 and the holding members 41 and 42 into one piece. The casing 5 houses, as shown in FIG. 1, an assembly 10 that includes the coil 2, the magnetic core 3, and the holding members 41 and 42. The casing 5 is, as shown in FIGS. 2 and 3, a tubular container that is closed on one side, that is, a container in which a bottom plate portion 51 and a side wall portion 52 form a housing space of the assembly 10, and an opening 55 is formed on the side opposite to the bottom plate portion 51. The potting resin portion 6 fills up the casing 5 to seal at least a part of the assembly 10.

Examples of features of the reactor 1A according to Embodiment 1 include the following configurations:

(1) The thermal conductivity of the potting resin portion 6 is higher than the thermal conductivity of the mold resin portion 8;

(2) As shown in FIG. 4, the mold resin portion 8 includes first regions 81 and second region 82 that are formed in one piece. The first regions 81 cover at least part of the inner circumferential surfaces of the wound portions 21. The second regions 82 latch on the holding members 41 and 42 so that the holding members 41 and 42 do not disengage from the end faces of the wound portions 21; and (3) As shown in FIGS. 2 and 3, both the mold resin portion 8 (first region 81) and the potting resin portion 6 are provided between the wound portion 21 and the inner core portion 31.

In this example, as shown in FIG. 1, the assembly 10 is housed in the casing 5 such that a parallel direction in which the two wound portions 21 of the coil 2 are arranged in parallel to each other, and their axial direction are parallel to the bottom plate portion 51 (FIG. 2). FIG. 4 shows a coil member 20 in which the coil 2 and the holding members 41 and 42 are integrated into one piece by the mold resin portion 8. In the following description, the bottom plate portion 51 side is defined as the "lower side", and the side (opening 55 side) opposite to the bottom plate portion 51 side is defined as the "upper side". The up-down direction (vertical direction in the paper plane in FIGS. 2 and 3) is defined as the "height direction". The direction along the parallel direction of the wound portions 21 (horizontal direction in the paper plane in FIG. 2) is defined as the "width direction". The direction along the axial direction of the wound portion 21 (horizontal direction in the paper plane in FIG. 3) is defined as the "length direction". Note that, in FIG. 6, the inner core portions 31, and the first regions 81 (excluding the portions behind protrusions 44) of the mold resin portion 8 are hatched (the same applies to FIG. 8) in order to make the drawings easier to comprehend. Also, in FIG. 7, the first regions 81 (excluding the portions behind protrusions 44) of the mold resin portion 8 are hatched.

Hereinafter, the configuration of the reactor 1A will be described in detail.

Coil

Figure 5:
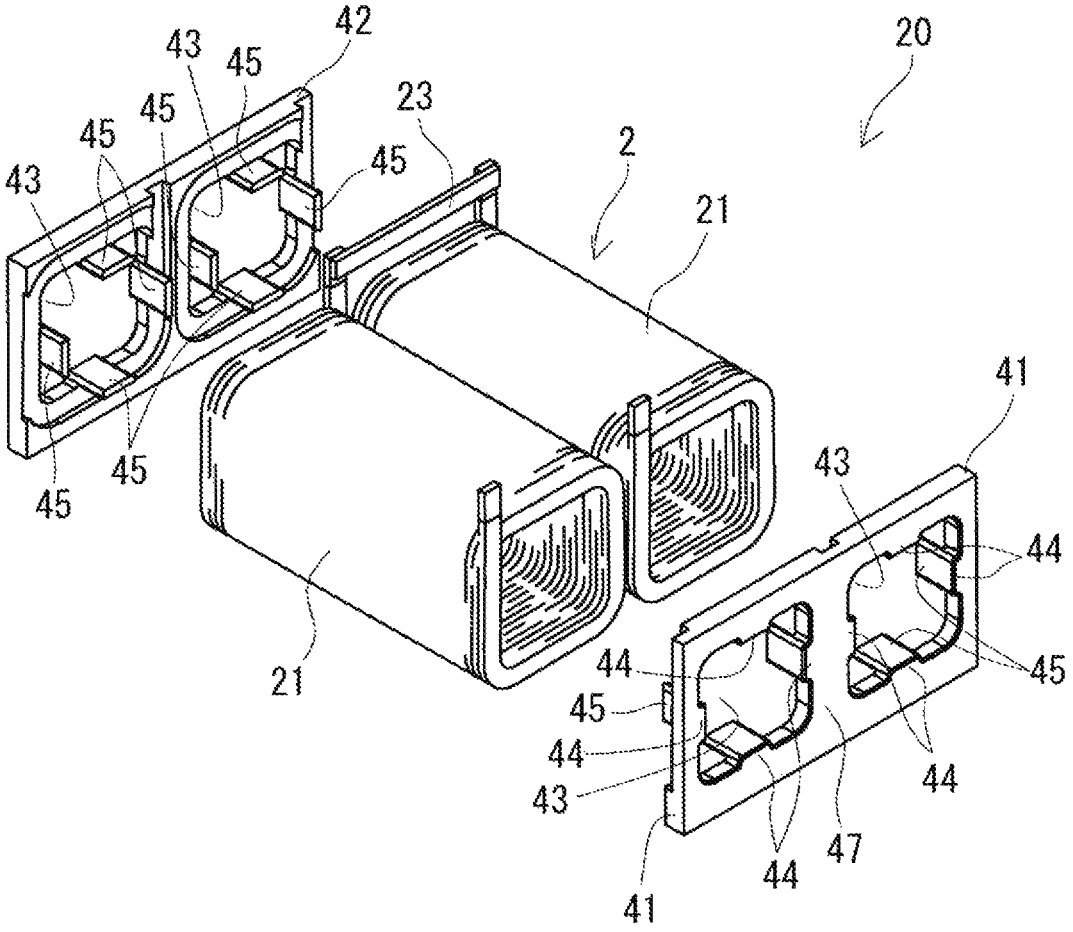
FIG. 5 is a schematic exploded view of a coil member.

As shown in FIGS. 1 and 5, the coil 2 includes the pair of wound portions 21. Each of the wound portions 21 is obtained by helically winding a coil wire. The end portions, on one side, of the coil wires of the two wound portions 21 are connected to each other via a connection piece 23. The two wound portions 21 are arranged side by side (in parallel) so that their axes are parallel to each other. The connection piece 23 is joined to the end portions, on one side, of the coil wires of the wound portions 21 using a joining method such as welding, soldering, or brazing, for example. The end portions, on the other side, of the coil wires are drawn out of the wound portions 21 in a suitable direction (upward in this example), and a terminal fitting (not shown) is appropriately attached to the end portions. An external device (not shown) such as a power supply is electrically connected to the terminal fitting. In this example, the wound portions 21 are formed by winding separate coil wires, but the two wound portions 21 may also be formed by a single continuous coil wire. A well-known coil may be used as the coil 2.

The coil wire may be a covered wire that includes a conductor wire and an insulating covering. The conductor wire may be made of copper. The insulating covering may be made of a resin such as a polyamide-imide resin. Examples of the covered wire include a covered rectangular wire having a rectangular cross section, and a covered round wire having a circular cross section.

The two wound portions 21 are made of coil wires having the same specification, and have the same shape, size, winding direction, and the same number of turns. In this example, the wound portions 21 are quadrangularly tubular (specifically, rectangularly tubular) edgewise coils obtained by winding a covered rectangular wire in an edgewise manner (see FIG. 5). The shape of the wound portions 21 is not particularly limited, and the wound portions 21 may have the shape of, for example, a circular tube, an ellipsoidal tube, an oblong tube, or the like. Furthermore, the two wound portions 21 may be made of coil wires having different specifications, or may also have different shapes.

In this example, as shown in FIG. 4, the outer circumferential surfaces of the wound portions 21 are not covered by the mold resin portion 8, and in the state of the assembly 10 (coil member 20), the outer circumferential surfaces of the wound portions 21 are exposed. Accordingly, heat is likely to dissipate from the wound portions 21, which improves the heat dissipation of the coil 2.

Magnetic Core

As shown in FIGS. 2 and 3, the magnetic core 3 includes the pair of inner core portions 31 arranged inside the respective wound portions 21, and the pair of outer core portions 33 arranged outside the respective wound portions 21 (see also FIG. 4). The inner core portions 31 may be such that the end portions in their axial direction protrude from the wound portions 21. The two outer core portions 33 are each provided so as to connect the corresponding end portions of the two inner core portions 31. In this example, the outer core portions 33 sandwich the inner core portions 31 from both sides. The magnetic core 3 forms a loop as a result of the end faces of the two inner core portions 31 being connected to inner end faces 33*e* of the outer core portions 33 (FIG. 4). The end faces of the two inner core portions 31 may also be adhered to the inner end faces 33*e* of the outer core portions 33. When the coil 2 is excited, a magnetic flux flows through the magnetic core 3 and forms a closed magnetic path.

Inner Core Portions

The shape of the inner core portions 31 substantially conforms to the inner circumferential shape of the wound portions 21. In this example, the inner core portions 31 have the shape of a square column (rectangular column), and the end faces of the inner core portions 31 are rectangular when viewed in the axial direction (see also FIG. 4). The corners of the inner core portions 31 are chamfered. The two inner core portions 31 have the same shape and size. Also, in this example, the end portions of the two inner core portions 31 protrude from the end faces of the wound portions 21. The end portions protruding from the wound portions 21 are also included in the inner core portions 31. As shown in FIG. 3, the end portions of the inner core portions 31 that protrude from the wound portions 21 are inserted into through holes 43 formed in the later-described holding members 41 and 42.

In this example, the inner core portions 31 are each constituted by a single columnar core piece. The core piece constituting the inner core portion 31 has a length substantially equal to the entire length, in the axial direction, of the wound portions 21. Note that each inner core portion 31 may be constituted by a plurality of core pieces, and a gap material interposed between adjacent core pieces.

Outer Core Portions

The shape of the outer core portions 33 is not particularly limited as long as they are shaped to connect the end portions of the two inner core portions 31. The outer core portions 33 each have an inner end face 33*e* that faces the corresponding end faces of the two inner core portions 31 (FIG. 4). In this example, the outer core portions 33 have the shape of a substantially trapezoidal column. The two outer core portions 33 have the same shape and size. The outer core portions 33 are each constituted by a single columnar core piece.

Constituent Material

The inner core portions 31 and the outer core portions 33 are made of a compacted material that contains a soft magnetic material. The soft magnetic material may be metal such as iron, or an iron alloy (e. g., a Fe—Si alloy, a Fe—Ni alloy, or the like), or non-metal such as ferrite. Examples of the compacted material that contains a soft magnetic material include a powder compacted material obtained by compacting and molding powder (soft magnetic powder) made of a soft magnetic material, and a composite material obtained by dispersing soft magnetic powder in a resin and molding the result. A composite material can be obtained by filling a mold with a raw material in which soft magnetic powder is mixed into an unsolidified resin, and solidifying the resin. A powder compacted material has a higher ratio of soft magnetic powder to a core piece than a composite material does. If a composite material is used, it will be easy to control the magnetic characteristics (relative permeability or saturation magnetic flux density) by adjusting the content of soft magnetic powder in a resin.

Soft magnetic powder is an aggregation of soft magnetic particles. The soft magnetic particles may also be covered particles whose surfaces are covered with an insulating covering. The insulating covering may contain phosphoric salt serving as a constituent material. Examples of the resin of the composite material include a thermosetting resin such as an epoxy resin, a phenol resin, a silicone resin, and an urethane resin, and a thermoplastic resin such as a polyphenylene sulphide (PPS) resin, a polyamide (PA) resin (such as nylon 6, nylon 66, and nylon 9T), a liquid-crystal polymer (LCP), a polyimide (PI) resin, and a fluorine resin (such as a polytetrafluoroethylene (PTFE) resin).

At least either the inner core portions 31 or the outer core portions 33 may be made of a powder compacted material or a composite material. The inner core portions 31 and the outer core portions 33 may be made of the same constituent material or different constituent materials. For example, the inner core portions 31 and the outer core portions 33 may be respectively made of composite materials whose soft magnetic powders are of different types or contents. Furthermore, a configuration is also possible in which the inner core portions 31 are made of a composite material and the outer core portions 33 are made of a powder compacted material, or the inner core portions 31 are made of a powder compacted material and the outer core portions 33 are made of a composite material. In this example, the inner core portions 31 are made of a composite material, and the outer core portions 33 are made of a powder compacted material. The magnetic core 3 of the present example does not include a gap material.

Holding Members

As shown in FIGS. 3 and 5, the holding members 41 and 42 are arranged so as to face the end faces, on both sides, of the wound portions 21. The holding members 41 and 42 maintain a state in which the coil 2 (wound portions 21) and the inner core portions 31 are positioned with respect to each other. Furthermore, the holding members 41 and 42 ensure electrical insulation between the coil 2 and the magnetic core 3. The basic configurations of the holding members 41 and 42 are the same. In this example, as shown in FIG. 5, the holding members 41 and 42 are rectangular frame-shaped.

Figure 6:
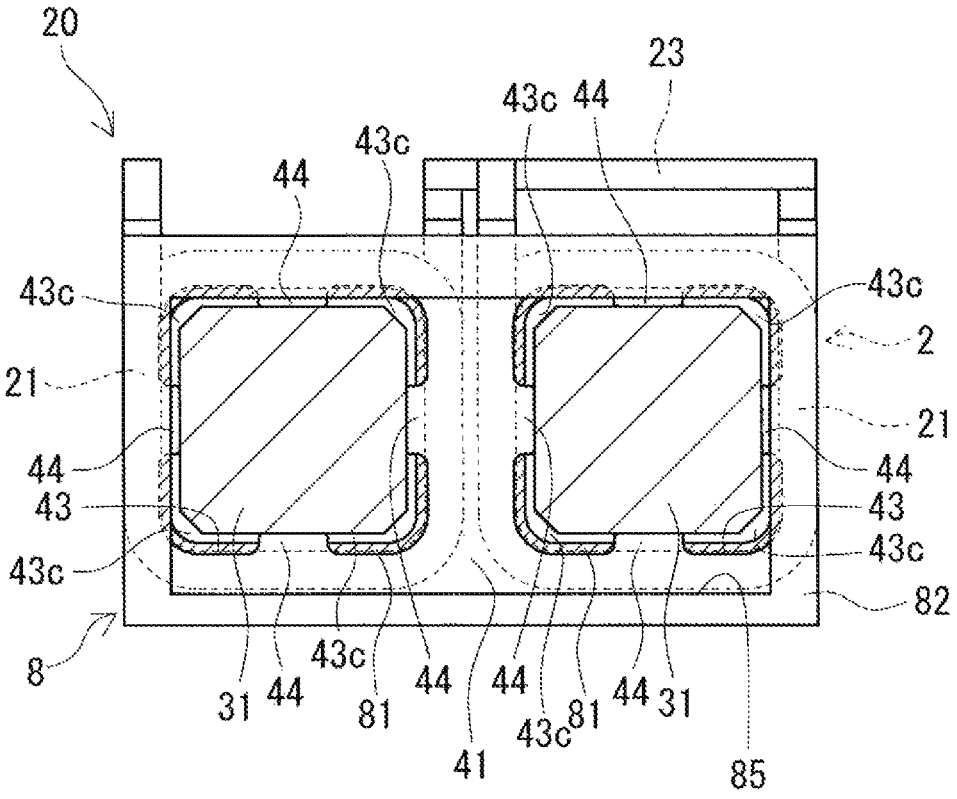
FIG. 6 is a schematic diagram illustrating an assembly of the coil member and inner core portions, viewed from the end face side of wound portions.

As shown in FIG. 3, the holding members 41 and 42 are arranged between the end faces of the wound portions 21 and the inner end face 33*e* of the outer core portion 33, and ensure electrical insulation between the wound portions 21 and the outer core portions 33. The holding members 41 and 42 include a pair of through holes 43. The end portions of the inner core portions 31 are respectively inserted into the through holes 43. The shape of the through holes 43 substantially conforms to the outer circumferential shape of the end portions of the inner core portions 31. As a result of the end portions of the inner core portions 31 being inserted into the through holes 43, the inner core portions 31 are held. Each of the through holes 43 is provided so that clearance gaps 43*c* (FIGS. 6 and 7) are partially formed between the outer circumferential surface of the corresponding inner core portion 31 and the inner circumferential surface of the through hole 43 in a state in which the end portion of the inner core portion 31 is inserted into the through hole 43. These clearance gaps 43*c* are in communication with a clearance gap formed between the inner circumferential surface of the corresponding wound portion 21 and the outer circumferential surface of the inner core portion 31. In this example, as shown in FIGS. 5 and 6, each through hole 43 is recessed to the outer side at the four corners thereof, and the central portion between every two of the four corners of the through hole 43 serves as a protrusion 44. As a result of the outer circumferential surface of the inner core portion 31 coming into contact with the protrusions 44, the inner core portion 31 is held inside the through hole 43.

As shown in FIG. 5, the holding members 41 and 42 include, on the end face side of the wound portions 21, holding pieces 45 that protrude from the rims of the through holes 43 to the inside of the wound portions 21. In this example, the holding pieces 45 are provided at positions of the protrusions 44 of the through holes 43, and are arranged on the inner circumferential surfaces of the wound portions 21 (see also FIG. 4). The holding pieces 45 are inserted between the wound portion 21 and the inner core portion 31. The wound portion 21 and the inner core portion 31 are held while being distanced from each other by the holding pieces 45, which can ensure the electrical insulation between the wound portion 21 and the inner core portion 31.

Constituent Material

The holding members 41 and 42 are made of an electrically insulating material. A typical electrically insulating material may be resin. Specific examples of the electrically insulating material include a thermosetting resin such as an epoxy resin, a phenol resin, a silicone resin, an urethane resin, and an unsaturated polyester resin, and a thermoplastic resin such as a PPS resin, a PA resin, an LCP, a PI resin, a fluorine resin (such as PTFE resin), a polybutylene terephthalate (PBT) resin, and an acrylonitrile-butadiene-styrene (ABS) resin. In this example, the holding members 41 and 42 are made of a PPS resin.

Mold Resin Portion

As shown in FIG. 4, the mold resin portion 8 integrates the coil 2 and the holding members 41 and 42 into one piece. As a result of the coil 2 and the holding members 41 and 42 being integrated into one piece by the mold resin portion 8, the coil member 20 is formed. The mold resin portion 8 includes the first regions 81 and the second regions 82. The first regions 81 and the second regions 82 are formed in one piece. The first regions 81 cover at least part of the inner circumferential surfaces of the wound portions 21. The second regions 82 latch on the holding members 41 and 42 so that the holding members 41 and 42 do not disengage from the end faces of the wound portions 21. In this example, the first regions 81 each cover the whole circumference (excluding however the portions that face the holding pieces 45) of the inner circumferential surface of the corresponding wound portion 21 (see also FIG. 2). Furthermore, in this example, the second regions 82 extend from the inner circumferential surfaces of the wound portions 21, passing through the through holes 43 of the holding members 41 and 42, and reach the side (opposing face 47 side) of the holding members 41 and 42 that face the outer core portions 33. In other words, the holding members 41 and 42 are interposed between the end faces of the wound portions 21 and the second region 82. The configuration is such that, as a result of the second regions 82 reaching the opposing face 47 side of the respective holding members 41 and 42, the second regions 82 latch on the holding members 41 and 42. As a result of the second regions 82 latching on the holding members 41 and 42, the wound portions 21 and the holding members 41 and 42 are mechanically coupled to each other by the mold resin portion 8.

The term "the second regions 82 latching on the holding members 41 and 42" means that the second regions 82 protrude from the first regions 81 in a direction that intersects with the axial direction of the wound portions 21 to restrict the movement of the holding members 41 and 42 in a direction of separating away from the end faces of the wound portions 21.

The second regions 82 of the present example are formed in the shape of a frame that conforms to the outer rim of the opposing face 47 of the holding member 41 and 42, and the portions inside of the second regions 82 serve as recesses 85. The recesses 85 house the inner end faces 33*e* of the outer core portions 33.

As shown in FIG. 3, each first region 81 of the present example is provided continuously over the entire length of the inner circumferential surface of the corresponding wound portion 21. In other words, the second region 82 provided on the opposing face 47 of one holding member 41 is connected to the second region 82 provided on the opposing face 47 of the other holding member 42 via the first regions 81. Accordingly, the wound portions 21, and the holding members 41 and 42 can be more strongly coupled to each other by the mold resin portion 8. Furthermore, as described above, each first region 81 is provided while covering the whole circumference of the inner circumferential surface of the corresponding wound portion 21. Accordingly, an area of contact between the first region 81 and the inner circumferential surface of the wound portion 21 is increased, and thus the strength of the joint between the first region 81 and the wound portion 21 is enhanced. Also, in this regard, the wound portions 21, and the holding members 41 and 42 can be more strongly coupled to each other by the mold resin portion 8. Furthermore, as shown in FIG. 6, the thickness of the first regions 81 of the present example is smaller than the protrusion height of the protrusions 44 provided in the through holes 43 of the holding members 41 and 42. In other words, when viewed in the axial direction of the wound portions 21, a step is formed, on both sides of a protrusion 44, between the protrusion 44 and the first region 81. Accordingly, in a state in which the inner core portions 31 are inserted into the through holes 43, the clearance gaps 43*c* are formed at the four corners of each through hole 43. Note that, in the present example, the holding members 41 and 42 include the protrusions 44 and the holding pieces 45 (see FIG. 5), but as described later, a configuration is also possible in which the holding members 41 and 42 do not include the protrusions 44 and the holding pieces 45. Furthermore, the thickness of the first regions 81 may also be set to the same dimension as the protrusion height of the protrusions 44, or the first regions 81 may also have a thickness such that they cover the protrusions 44. The thickness of the first region 81 refers to the distance from the inner circumferential surface of a through hole 43 (that is, a wound portion 21) in a direction that is orthogonal to the inner circumferential surface (direction toward the inner core portion 31). If the first region 81 covers the protrusions 44, the thickness of the first region 81 is greater than the protrusion height of the protrusions 44.

The first regions 81 may also be provided only in the vicinity of the end portions of the wound portions 21 as long as they can hold the coil 2 and the holding members 41 and 42 together. In other words, the first regions 81 do not necessarily need to reach the central portions, in the axial direction, of the wound portions 21.

Constituent Material

The constituent material of the mold resin portion 8 (hereinafter, referred to also as "mold material") may be the constituent material of the above-described holding members 41 and 42. In this example, the mold resin portion 8 is made of a PPS resin.

Casing

As shown in FIGS. 1 to 3, the casing 5 houses the assembly 10 that includes the coil 2, the magnetic core 3, and the holding members 41 and 42. With the casing 5, it is possible to achieve mechanical protection of the assembly 10, and protection of the assembly 10 from the external environment (an improvement in anticorrosion performance). The casing 5 of the present example is made of metal. The metal casing 5 has a higher thermal conductivity than that of resin, and the heat of the assembly 10 is likely to dissipate to the outside via the casing 5. Accordingly, the metal casing 5 contributes to an improvement in heat dissipation of the assembly 10.

The casing 5 includes the bottom plate portion 51, the side wall portion 52, and the opening 55. The bottom plate portion 51 is a planar member on which the assembly 10 is placed. The side wall portion 52 is a quadrangularly tubular member that encloses the assembly 10. In this example, the bottom plate portion 51 and the side wall portion 52 are formed in one piece. The height of the casing 5 (side wall portion 52) is equal to or greater than the height of the assembly 10 (wound portions 21). In this example, the bottom plate portion 51 has the shape of a rectangular plate. Also, the side wall portion 52 has the shape of a rectangular tube (see FIG. 1). The bottom surface of the bottom plate portion 51 and the inner circumferential surface of the side wall portion 52 are substantially flat.

Constituent Material

The casing 5 is made of nonmagnetic metal. Examples of the nonmagnetic metal include aluminium and an alloy thereof, magnesium and an alloy thereof, copper and an alloy thereof, silver and an alloy thereof, and an austenitic stainless steel. These metals have relatively high thermal conductivity. Thus, the casing 5 can be used as a heat dissipation path, and can efficiently dissipate the heat of the assembly 10 to the outside. Accordingly, the heat dissipation of the assembly 10 is improved. Instead of metal, resin or the like may also be used as the material of the casing 5.

The metal casing 5 can be manufactured through die casting. The casing 5 of the present example is a die-cast article made of aluminium.

Potting Resin Portion

The potting resin portion 6 fills up the casing 5 to seal at least a part of the assembly 10. With the potting resin portion 6, it is possible to achieve mechanical protection of the assembly 10, and protection of the assembly 10 from the external environment (an improvement in anticorrosion performance). In this example, the potting resin portion 6 fills up the casing 5 to the level of the open end thereof, so that the entirety of the assembly 10 is sealed by the potting resin portion 6. A configuration is also possible in which only a part of the assembly 10 is sealed by the potting resin portion 6. For example, the assembly 10 may be sealed by the potting resin portion 6 to the level of the upper surfaces of the inner circumferential surfaces of the wound portions 21, or to almost the half of the height of the wound portions 21. Also, the potting resin portion 6 is interposed between the coil 2 (wound portions 21) and the casing 5 (side wall portion 52). Accordingly, it is possible to transmit the heat of the coil 2 to the casing 5 via the potting resin portion 6, improving the heat dissipation of the assembly 10.

Furthermore, as shown in FIGS. 2 and 3, the potting resin portion 6 also fills up spaces between the wound portions 21 and the inner core portions 31. In other words, both the first region 81 of the mold resin portion 8 and the potting resin portion 6 are provided between the wound portion 21 and the inner core portion 31. In this example, as described above, the first region 81 is provided covering the whole circumference of the inner circumferential surface of the wound portion 21. Therefore, the potting resin portion 6 and the first region 81 are stacked on each other between the wound portion 21 and the inner core portion 31. In this case, the heat dissipation path of the inner core portion 31 passes through, starting from the inner core portion 31, the potting resin portion 6, the mold resin portion 8 (first region 81), and the wound portion 21, in that order. Accordingly, it is possible to transmit the heat of the inner core portions 31 to the wound portions 21 more efficiently than in the case where only the mold resin portion 8 (first region 81) is provided between the wound portion 21 and the inner core portion 31. This is because the thermal conductivity of the potting resin portion 6 is higher than the thermal conductivity of the mold resin portion 8.

Constituent Material

Typically, the properties required for the constituent material (hereinafter, referred to also as "potting material") of the potting resin portion 6 include electrical insulation, weather resistance, heat resistance, and the like, and one of the most important properties is thermal conductivity. Accordingly, the components of the potting material are adjusted by adding fillers for improving the thermal conductivity, for example. On the other hand, one of the most important properties required for the constituent material (mold material) of the mold resin portion 8 is strength. Accordingly, the mold material basically has a lower thermal conductivity than the potting material. The thermal conductivity of the mold resin portion 8 (mold material) is, for example, between about 0.2 W/m·K and 0.4 W/m·K. In contrast, the thermal conductivity of the potting resin portion 6 (potting material) is equal to or greater than 1 W/m·K for example, and is preferably equal to or greater than 1.5 W/m·K. The higher the thermal conductivity of the potting resin portion 6 is, the more preferable it is. This is because the heat of the coil 2 is more easily transmitted to the casing 5.

The potting material is, for example, a material obtained by dispersing the above-described fillers into a resin that serves as a base material. Examples of the resin that serves as a base material include a thermosetting resin such as an epoxy resin, a silicone resin, a urethane resin, and an unsaturated polyester resin, and a thermoplastic resin such as a PPS resin. In this example, a silicone resin (more specifically, silicone gel) is used as the resin that serves as a base material. As the fillers, nonmagnetic powder, namely, ceramic or carbon nanotube powder may be used, examples of which include an oxidative product such as alumina, silica, and magnesium oxide, a nitride product such as silicon nitride, aluminium nitride, and boron nitride, or a carbide product such as silicon carbide.

The reason why the potting resin portion 6 fills up the spaces between the wound portions 21 and the inner core portions 31 is as follows.

Figure 7:
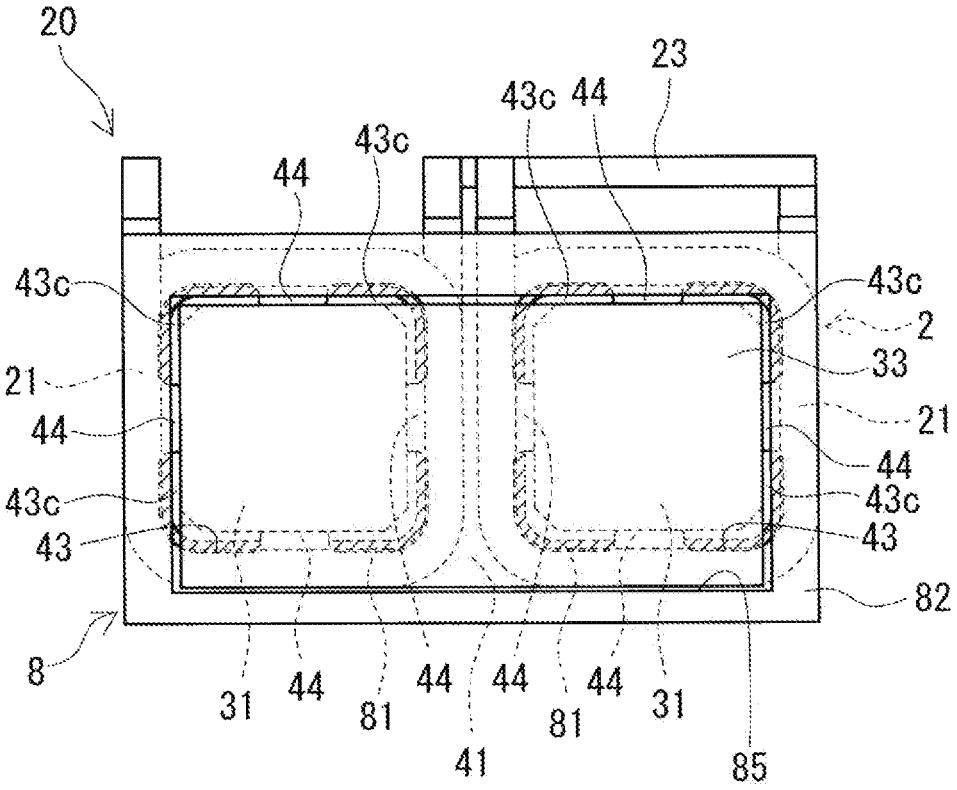
FIG. 7 is a schematic front view of the assembly.

As shown in FIG. 7, the outer core portion 33 is arranged on the opposing face 47 (FIG. 4) of the holding member 41 of the coil member 20. In a state in which the inner end face 33*e* (FIG. 4) of the outer core portion 33 is fitted into the recess 85 of the second region 82 of the mold resin portion 8, a clearance gap is partially formed between the outer circumferential surface of the outer core portion 33 and the inner circumferential surface of the recess 85. The clearance gap formed between the outer core portion 33 and the recess 85 is in communication with the above-described clearance gaps 43*c* formed between the inner core portions 31 and the through holes 43. As a result of these clearance gaps being in communication with each other, when the potting material is poured in a state in which the assembly 10 is housed in the casing 5 (see FIG. 1), the potting material also enters the spaces between the wound portions 21 and the inner core portions 31.

Additionally, an adhesive layer (not shown) may also be provided between the assembly 10 and the bottom plate portion 51. With the adhesive layer, the assembly 10 can be firmly fixed to the casing 5. The adhesive layer may be made of, for example, an electrically insulating resin. Examples of the electrically insulating resin of the adhesive layer include a thermosetting resin such as an epoxy resin, a silicone resin, and an unsaturated polyester resin, and a thermoplastic resin such as a PPS resin and an LCP. A commercially available adhesive sheet may be used as an adhesive layer, or a commercially available adhesive agent may be applied to form an adhesive layer.

Manufacturing Method

An example of a method for manufacturing the above-described reactor 1A will be described. The reactor 1A can be manufactured by a manufacturing method including the following first and second steps:

First step: a step for preparing the assembly 10 and the casing 5; and

Second step: a step for forming the potting resin portion 6 in a state in which the assembly 10 is housed in the casing 5.

First Step

In the first step, the assembly 10 is prepared (see FIGS. 4 and 5). As shown in FIG. 4, the assembly 10 is manufactured by assembling the coil member 20 and the magnetic core 3 together. For the coil member 20, the coil 2 and the holding members 41 and 42 are put together in advance using the mold resin portion 8. The coil member 20 can be manufactured by molding the mold resin portion 8, in a state in which, as shown in FIG. 5, the coil 2 and the holding members 41 and 42 are assembled together so that the holding members 41 and 42 are respectively arranged on both ends of the wound portions 21. For example, injection molding may be used to mold the mold resin portion 8. Specifically, the assembly of the coil 2 and the holding members 41 and 42 is put in a mold, and cores are inserted into the wound portions 21. The mold and the cores may be separate objects, or may be a slide mold with cores. In this state, a mold material is poured into the mold to form the mold resin portion 8 (the first regions 81 and the second regions 82). In this example, the mold resin portion 8 is molded such that the first regions 81 cover the whole circumference of the inner circumferential surfaces of the wound portions 21. For the assembly 10, as shown in FIG. 4, the inner core portions 31 are inserted into the through holes 43 of the holding members 41 and 42 of the coil member 20, and the inner core portions 31 are arranged inside the wound portions 21. Then, the outer core portions 33 are arranged so as to sandwich the inner core portions 31 from both sides. At this time, the end faces of the inner core portions 31 may be adhered to the inner end faces 33*e* of the outer core portions 33, or the opposing faces 47 of the holding members 41 and 42 may be adhered to the inner end faces 33*e* of the outer core portions 33.

The casing 5 made of, for example, nonmagnetic metal is prepared. In this example, the casing 5 is a die-cast article made of aluminium.

Second Step

In the second step, the potting resin portion 6 is formed in a state in which the assembly 10 is housed in the casing 5. Specifically, as shown in FIG. 1, the potting material is poured in the state in which the assembly 10 is housed in the casing 5, and the potting resin portion 6 is formed. For example, a nozzle may be inserted from the opening 55 of the casing 5 into a clearance gap between the assembly 10 and the side wall portion 52, and the potting material is injected through the nozzle. When the potting material is poured into the casing 5, part of the potting material passes through, as described above, the clearance gaps between the outer core portions 33 and the recesses 85 and the clearance gaps 43*c* between the inner core portions 31 and the through holes 43, and fills up the spaces between the wound portions 21 and the inner core portions 31 (see FIG. 7). In the case of the present example, as shown in FIGS. 2 and 3, the potting resin portion 6 and the first region 81 are stacked on each other between the wound portion 21 and the inner core portion 31.

The potting material is preferably poured in a vacuum state. For example, the casing 5 in which the assembly 10 is housed is put in a vacuum chamber, and the potting material is poured into the casing 5 in a vacuum state. By pouring the potting material in a vacuum state, it is possible to suppress air bubbles from occurring in the potting resin portion 6.

After the potting material has been poured into the casing 5, the potting material is solidified to form the potting resin portion 6 (FIG. 1). The solidification of the potting material may be performed under suitable conditions depending on the material to be used.

The present example employs a configuration in which the holding members 41 and 42 include the protrusions 44 and the holding pieces 45, but the protrusions 44 and the holding pieces 45 are not essential. In the case of the present example, with the protrusions 44 and the holding pieces 45, the inner core portions 31 are held in the through holes 43, and the distance between the wound portions 21 and the inner core portions 31 is held. Also, with the protrusions 44 and the holding pieces 45, the inner core portions 31 are respectively supported inside the wound portions 21, and thereby the clearance gaps to be filled with the potting resin portion 6 are respectively formed between the wound portions 21 and the inner core portions 31 (specifically, between the first region 81 and the inner core portion 31). However, the above-described clearance gaps between the wound portions 21 and the inner core portions 31 can also be formed by putting the outer core portions 33 and the inner core portions 31 together by, for example, adhering the inner core portions 31 to the outer core portions 33.

When, for example, the assembly 10 is formed in the first step, one outer core portion 33 and one inner core portion 31 are adhered to each other to form an integrated first core component. The inner core portion 31 of the first core component is inserted into the through holes 43 of the holding members 41 and 42 from one side of the coil member 20, and is arranged inside the corresponding wound portion 21. The other outer core portion 33 and the other inner core portion 31 are adhered to each other to form an integrated second core component. The inner core portion 31 of the second core component is inserted into the through holes 43 of the holding members 41 and 42 from the other side of the coil member, and is arranged inside the corresponding wound portion 21. In this case, since the inner core portions 31 are fixed to the outer core portions 33, the inner core portions 31 can be positioned in the state in which the above-described clearance gaps are respectively provided between the wound portions 21 and the inner core portions 31, even if the holding members 41 and 42 do not include the protrusions 44 and the holding pieces 45. Irrespective of whether or not there are the protrusions 44, the clearance gaps can be provided between the wound portions 21 and the inner core portions 31, and thus the thickness of the first regions 81 is not limited to the protrusion height of the protrusions 44. Accordingly, the thickness of the first regions 81 can also be set to such a thickness that it covers the protrusions 44 (a thickness greater than the protrusion height of the protrusions 44).

Main Effects

The reactor 1A of the Embodiment 1 achieves the following effects.

The potting resin portion 6 and the first region 81 of the mold resin portion 8 are stacked on each other between the wound portion 21 and the inner core portion 31. Accordingly, the reactor 1A can efficiently transmit the heat of the inner core portions 31 to the wound portions 21. Thus, the reactor 1A is superior in terms of heat dissipation.

The coil 2 and the holding members 41 and 42 are integrated into one piece by the mold resin portion 8. Accordingly, the coil 2 and the holding members 41 and 42 can be dealt with as one piece, and thus a user can easily assemble the magnetic core 3 (inner core portions 31 and the outer core portions 32) and the coil 2. Also, as a result of the coil 2 and the holding members 41 and 42 being integrated into one piece, the assembly 10, when housed into the casing 5, can be arranged in a stable manner. Accordingly, the reactor 1A is superior in terms of assembly properties.

Furthermore, each of the first regions 81 of the mold resin portion 8 is provided covering the whole circumference of the inner circumferential surface of the corresponding wound portion 21. Accordingly, the strength of joint between the first region 81 and the wound portion 21 is enhanced. Therefore, in the reactor 1A, the wound portions 21 and the holding members 41 and 42 can be more strongly coupled to each other by the mold resin portion 8.

Usages

The reactor 1A can be used as a component of a circuit that performs voltage step-up and step-down operations. The reactor 1A can be used as, for example, a constituent component of various types of converter or electric power converting device. Examples of the converter include an on-board converter (typically, a DC-DC converter) that is installed in a vehicle such as a hybrid automobile, a plug-in hybrid automobile, an electric automobile, or a fuel-cell-powered automobile, and a converter of an air conditioner.

Modification

In the above-described reactor 1A, as shown in FIG. 4, a case where the second regions 82 of the mold resin portion 8 reach the opposing face 47 side of the holding members 41 and 42 is given as an example. The position at which the second regions 82 are to be formed and the like are not particularly limited as long as the second regions 82 can latch on the holding members 41 and 42. For example, a configuration is possible in which holes are respectively formed in advance in the inner circumferential surfaces of the through holes 43 in the holding members 41 and 42, and the second regions 82 are fitted into the holes. Alternatively, a configuration is also possible in which, on the opposing face 47 side of the holding member 41, 42, recesses are provided in advance in the rim portions of the through holes 43 of the holding member 41, 42, and the second regions 82 are fitted into the recesses. In both cases, it is possible to let the second regions 82 latch on the holding members 41 and 42 so that the holding members 41 and 42 do not disengage from the end faces of the wound portions 21.

Embodiment 2

Hereinafter, a reactor 1B according to Embodiment 2 will be described with reference to FIG. 8. Embodiment 2 illustrates an aspect in which the first region 81 is provided in a partial region in the circumferential direction between the wound portion 21 and the inner core portion 31, and the potting resin portion 6 is provided in the remaining region in the circumferential direction between the wound portion 21 and the inner core portion 31. The following description will be made focusing on differences from the above-described Embodiment 1, and the description of the same components will be omitted.

Figure 8:
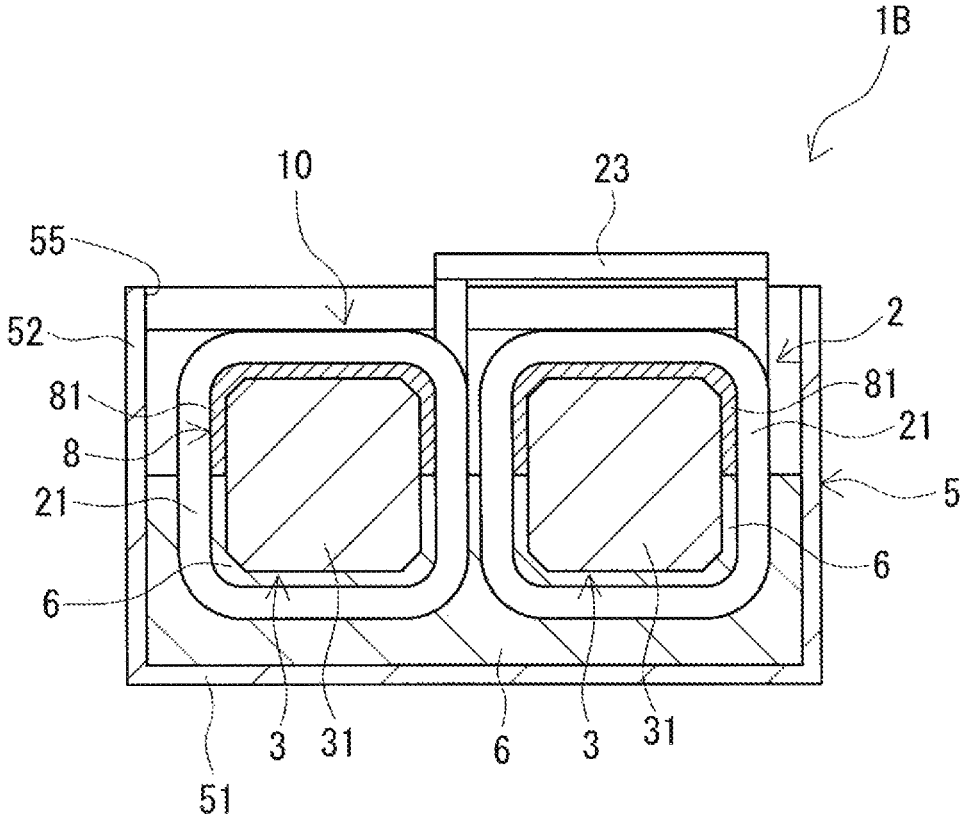
FIG. 8 is a schematic horizontal cross-sectional view illustrating a reactor according to Embodiment 2.

As shown in FIG. 8, in the reactor 1B, each first region 81 of the mold resin portion 8 is provided covering a partial region of the inner circumferential surface of the corresponding wound portion 21. In this example, the first region 81 is provided covering the upper half of the inner circumferential surface of the wound portion 21. Accordingly, the first region 81 is present in the upper half region between the wound portion 21 and the inner core portion 31. Furthermore, the potting resin portion 6 is provided between the remaining region between the wound portion 21 and the inner core portion 31, that is, in the lower half region. The reactor 1B can ensure the heat dissipation of the inner core portions 31, as a result of the potting resin portion 6 being provided in the remaining region (in the lower half region in this example) between the wound portion 21 and the inner core portion 31. In the reactor 1B, similar to the reactor 1A of Embodiment 1, the second regions 82 are formed in the shape of a frame extending along the outer rim of the opposing face 47 of the holding member 41, 42 (see FIGS. 3 and 4).

The thickness of the first regions 81 in the present example is the same as the protrusion height of the protrusions 44 formed on the through holes 43 of the holding members 41 and 42 as shown in FIG. 6. In other words, the thickness of the first regions 81 is substantially equal to the distance between the inner circumferential surface of the wound portion 21 and the outer circumferential surface of the inner core portion 31. Furthermore, the second region 82 reaches the opposing face 47 side from the first region 81 via the upper portions of the through holes 43 of the holding member 41, and is formed in the shape of a frame extending along the outer rim of the opposing face 47. Note that, as described above, the thickness of the first regions 81 does not need to be the same as the protrusion height of the protrusions 44 but may be such that the first regions 81 cover the protrusions 44.

In the reactor 1B, the first region 81 is provided in a partial region (upper half region in this example) in the circumferential direction between the wound portion 21 and the inner core portion 31. Accordingly, in the reactor 1B, as in the reactor 1A of Embodiment 1, the first region 81 are thicker than in the case where the potting resin portion 6 and the first region 81 are stacked on each other between the wound portion 21 and the inner core portion 31. The rigidity of the first region 81 increases the thicker the first region 81 is. Therefore, in the reactor 1B, the wound portions 21 and the holding members 41 and 42 can be more strongly coupled to each other by the mold resin portion 8.

Furthermore, in the reactor 1B, as shown in FIG. 8, the potting resin portion 6 fills up the casing 5 to the level of almost half of the height of the wound portions 21. When the potting resin portion 6 fills up to the level of almost half of the height of the wound portions 21, the potting resin portion 6 can be provided in the lower half region between the wound portion 21 and the inner core portion 31. Since the potting resin portion 6 fills up only to the level of almost half of the height of the wound portions 21, which can reduce the amount of the potting material to be used. Typically, a potting material is more expensive than a mold material. Therefore, the manufacturing cost of the reactor 1B can be reduced by the reduction of the amount of the potting material to be used.

What is claimed is:

1. A reactor comprising:

a coil having a wound portion;

a magnetic core;

a holding member provided at both ends of the wound portion;

a mold resin by which the coil and the holding member are integrated into one piece;

a casing that houses an assembly that includes the coil, the magnetic core, and the holding member; and a potting resin that fills up the casing to seal at least a part of the assembly, wherein the magnetic core includes:

an inner core arranged inside the wound portion; and an outer core arranged outside the wound portion, the potting resin has a thermal conductivity that is higher than the thermal conductivity of the mold resin, the mold resin includes a first region and a second region that are formed in one piece, the first region covers at least part of an inner circumferential surface of the wound portion, and the second region latches on the holding member so that the holding member does not disengage from an end face of the wound portion, and both the first region and the potting resin are provided between the wound portion and the inner core.

2. The reactor according to claim 1, wherein:

the first region covers a whole circumference of the inner circumferential surface of the wound portion, and in a cross section that is orthogonal to an axial direction of the wound portion, the potting resin and the first region are stacked on each other between the wound portion and the inner core.

3. The reactor according to claim 1, wherein, in a cross section that is orthogonal to an axial direction of the wound portion, the first region is provided in a partial region, in a circumferential direction, between the wound portion and the inner core, and the potting resin is provided in a remaining region, in the circumferential direction, between the wound portion and the inner core.

4. The reactor according to claim 1, wherein an outer circumferential surface of the wound portion is exposed without being covered by the mold resin.

5. The reactor according to claim 1, wherein at least either of the inner core and the outer core is made of a powder compacted material that contains soft magnetic powder, or a composite material in which soft magnetic powder is dispersed in a resin.

* * * * *